US009570839B2

(12) United States Patent
Hashimoto

(10) Patent No.: US 9,570,839 B2
(45) Date of Patent: Feb. 14, 2017

(54) WATERPROOF CONNECTOR

(71) Applicant: Sumitomo Wiring Systems, Ltd., Mie (JP)

(72) Inventor: Norihito Hashimoto, Mie (JP)

(73) Assignee: Sumitomo Wiring Systems, Ltd. (JM)

( * ) Notice: Subject to any disclaimer, the term of this patent is extended or adjusted under 35 U.S.C. 154(b) by 0 days.

(21) Appl. No.: 14/935,520

(22) Filed: Nov. 9, 2015

(65) Prior Publication Data

US 2016/0156124 A1 Jun. 2, 2016

(30) Foreign Application Priority Data

Dec. 1, 2014 (JP) ..... 2014-242761

(51) Int. Cl.
*H01R 13/52* (2006.01)

(52) U.S. Cl.
CPC ..... *H01R 13/5202* (2013.01)

(58) Field of Classification Search
USPC ..... 439/271, 272, 278, 587, 277; 174/153 G
See application file for complete search history.

(56) References Cited

U.S. PATENT DOCUMENTS 8,317,530 B2 * 11/2012 Sawairi ..... H01R 13/5219 439/271
8,348,689 B2 * 1/2013 Shibata ..... H01R 13/5202 174/153 G

FOREIGN PATENT DOCUMENTS

JP 7-288150 10/1995

* cited by examiner

*Primary Examiner* — Alexander Gilman
(74) *Attorney, Agent, or Firm* — Gerald E. Hespos; Michael J. Porco; Matthew J. Hespos

(57) ABSTRACT

A seal (40) includes an annular portion (41) to be fit externally on a housing main body (11) and resiliently sandwiched between the housing main body (11) and a receptacle (71) when two housings (10, 70) are connected and projections (42) protruding radially out after projecting back from the annular portion (41) and configured such that protruding parts thereof resiliently contact the tip of the receptacle (71) when the two housings (10, 70) are connected. The housing (10) includes deformation guides (24) configured to deform the seal (40) such that a radially outward protruding amount of the projections (42) gradually increases by sliding on the projections (42) in the process of moving the annular portion (41) externally fit on the housing main body (11) toward a proper mounted position.

6 Claims, 6 Drawing Sheets

WATERPROOF CONNECTOR

BACKGROUND

1. Field of the Invention

The invention relates to a waterproof connector.

2. Description of the Related Art

Japanese Unexamined Patent Publication No. H07-288150 discloses a waterproof connector with a male housing that has an inner tube and an annular seal with an annular portion to be fit externally on the inner tube. The male housing is connectable to a mating female housing. Two locking projections are provided on both end parts of the annular seal. Each locking projection has an L-shaped locking piece that projects in the mounting direction and then protrudes radially out. The locking projections are inserted into and locked to through holes of the male housing to fix the annular seal to the male housing.

Backlash preventing projections could replace the locking projections of the aforementioned annular seal. Backlash preventing projections resiliently contact the tip of a mating receptacle when the two housings are connected and suppress backlash of housings in a front-back direction. Projections of this type have an L shape similar to the above-described locking projections. However, parts of the projections between protruding parts on tips of the projections and the annular portion from which the projections extend are long in the front-back direction and thin in transverse directions. Thus, these parts are difficult to mold and there is a problem with mass productivity.

The invention was completed based on the above situation and aims to provide a waterproof connector capable of improving the mass productivity of a seal.

SUMMARY

The invention is directed to a waterproof connector with a housing that has a main body and a seal. The main body can fit into a receptacle of a mating housing. The seal has an annular portion to be fit externally on the main body of the housing from the front and is sandwiched resiliently in a radial direction perpendicular to a front-back direction between the main body and the receptacle when the two housings are connected. The seal further has a projection that projects back from the annular portion and then protrudes radially out. The projection is configured so that a protruding part thereof resiliently contacts the tip of the receptacle in the front-back direction when the two housings are connected. The housing includes a deformation guide configured to deform the seal so that a radially outward protruding amount of the projection gradually increases by sliding on the projection in the process of moving the annular portion externally fit on the main body toward a proper mounted position.

The radially outward protruding amount of the projection is increased gradually by the deformation guide in the process of moving the annular portion toward the proper mounted position. The radially outward protruding amount of the projection is small before the seal is mounted on the housing. Thus, the seal and the projection thereof can be molded easily by a mold from which the seal is removed in the front-back direction and the difficulty of molding is solved. As a result, the mass productivity of the seal can be improved.

The deformation guide may include a slant curved radially out. According to this, the deformation of the projection is guided smoothly along the slant of the deformation guide.

The projection may include a backlash preventing portion projecting forward and capable of contacting the tip of the receptacle when the annular portion reaches the proper mounted position. The backlash preventing portion reliably suppresses backlash of the two housings in a connected state in the front-back direction.

DETAILED DESCRIPTION

Figure 1:
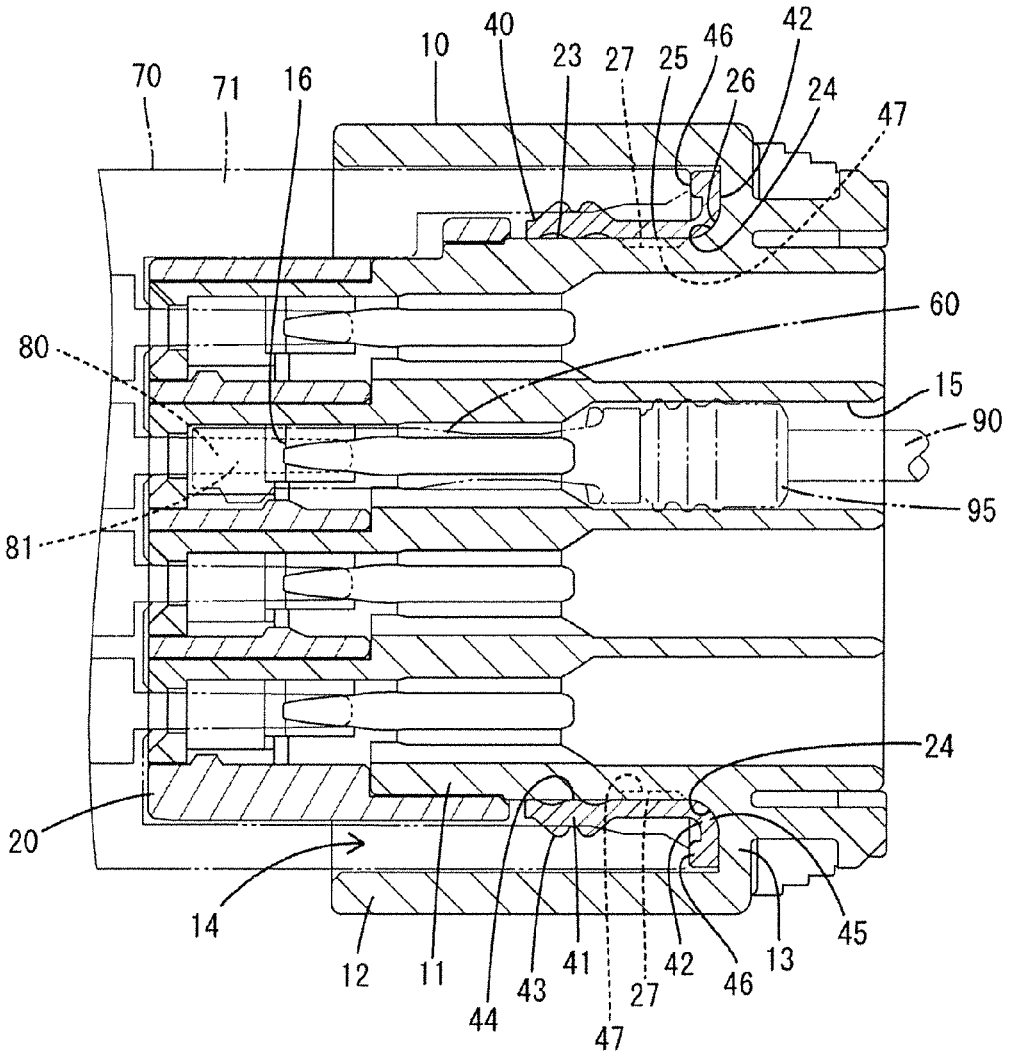
FIG. 1 is a section of a waterproof connector according to an embodiment of the invention.

An embodiment of the invention is described with reference to FIGS. 1 to 7. A waterproof connector of this embodiment has a housing 10, a seal 40 to be mounted on the housing 10 and terminal fittings 60 to be accommodated in the housing 10, as shown in FIG. 1. The housing 10 is connectable to a mating housing 70. In the following description, ends facing each other at the start of the connection of the housings 10, 70 are referred to as front ends concerning a front-back direction. Further, vertical and lateral directions are based on FIGS. 2 and 3.

The mating housing 70 is made of synthetic resin and includes a tubular receptacle 71 projecting forward, as shown in FIG. 1. Male tabs 81 of mating terminal fittings 80 project into the receptacle 71. Further, an unillustrated lock projects on the upper wall of the receptacle 71.

Figure 3:
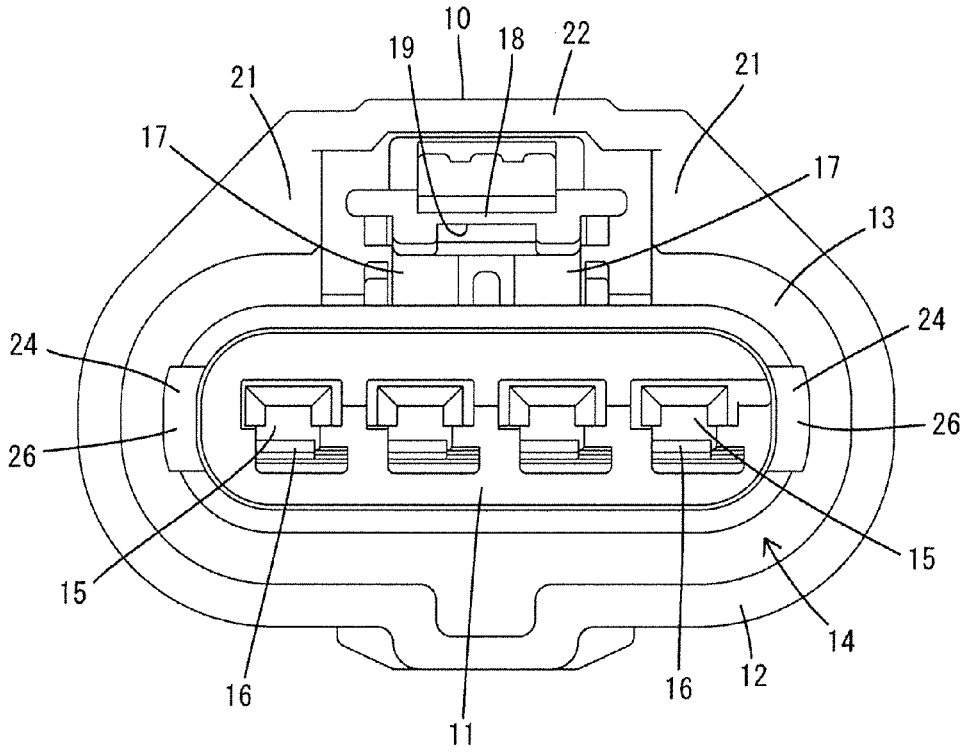
FIG. 3 is a front view of a housing.

The housing 10 also is made of synthetic resin and, as shown in FIG. 3, includes a main body 11 flat in the lateral direction, a fitting tube 12 surrounding the main body 11 and a radially extending coupling 13 connecting rear parts of the main body 11 and the fitting tube 12. As shown in FIG. 1, a forwardly open connection space 14 is formed between the main body 11 and the fitting tube 12 forward of the coupling 13 and can receive the receptacle 71 of the mating housing 70.

As shown in FIG. 1, cavities 15 penetrate through the main body 11 in the front-back direction. As shown in FIG. 3, the cavities 15 are arranged in a row in the lateral direction. A deflectable locking lance 16 projects forward at the lower wall of each cavity 15, and the terminal fittings 60 are inserted into the respective cavities 15 from behind.

The terminal fitting 60 is made of electrically conductive metal and, as shown in FIG. 1, is connected electrically conductively to the male tab 81 of the mating terminal fitting 80 when the housings 10, 70 are connected. A rear end part of the terminal fitting 60 is crimped and connected to a core of a wire 90 exposed at an end part and further is crimped and connected to a rubber plug 95 fit externally on a coating part behind the exposed core. The locking lance 16 retains the terminal fitting 60 in the cavity 15. The rubber plug 95 is inserted in the cavity 15 with the terminal fitting so that the interior of the cavity 15 is held liquid tight.

Figure 2:
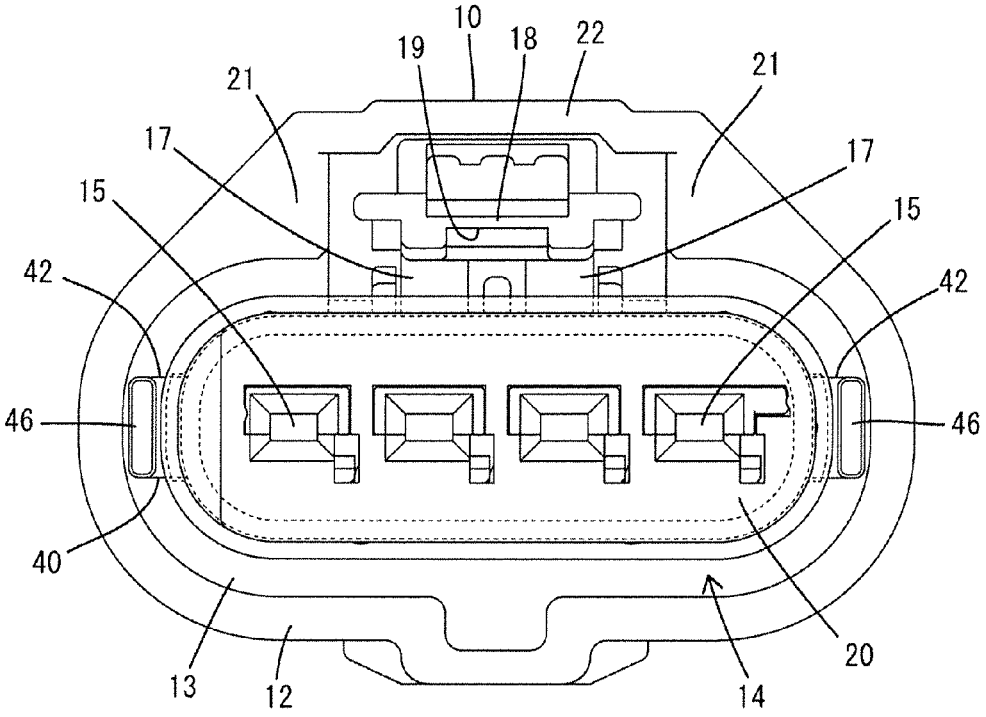
FIG. 2 is a front view of the waterproof connector.

A separate front member 20 is mounted on the main body 11 from front, as shown in FIGS. 1 and 2. The front member 20 is made of synthetic resin and defines a cap capable of covering the front surface of the main body 11. When the front member 20 is mounted properly on the main body 11 with the terminal fittings 60 held in the cavities 15, the deflection of the locking lances 16 is regulated by the front member 20 and the terminal fittings 60 are retained reliably. A rear part of the front member 20 can contact the front end of the seal 40 mounted on the housing 10 and functions to regulate forward detachment of the seal 40 from the housing 10.

Two legs 17 are provided on the upper surface of the main body 11, as shown in FIG. 3, and a lock arm 18 extends unitarily forward and backward from the upper ends of the legs 17. The lock arm 18 is deflectable and deformable in the vertical direction with the upper ends of the both legs 17 as supports. A lock receiving portion 19 is provided on a front end of the lock arm 18. The lock arm 18 is deflected and deformed in the process of connecting the two housings 10, 70. The lock arm 18 resiliently returns when the housings 10, 70 are connected properly, and the lock of the mating housing 70 is fit into the lock receiving portion 19 to hold the housings 10, 70 together.

As shown in FIG. 3, side walls 21 are provided at opposite left and right sides of the lock arm 18 on the top of the fitting tube 12. The lock arm 18 is exposed upward between the side walls 21. Further, a bridge 22 spans between upper parts of the front ends of the side walls 21 on the top of the fitting tube 12.

A mounting area 23 is formed before the coupling 13 and the legs 17 on the outer peripheral surface of the housing main body 11 (see FIG. 1) and an annular portion 41 of the seal 40 can be fit externally thereon in close contact. The mounting area 23 is substantially even and continuous in the front-back direction. Further, deformation guides 24 are provided on left and right end parts of the housing 10 in a range from the rear end of the mounting area 23 to the front surface of the coupling 13 and are capable of guiding the deformation of the seal 40.

As shown in FIG. 1, the deformation guide 24 is composed of a straight surface 25 arranged substantially along the front-back direction on the outer peripheral surface of the housing main body 11 and a slant 26 having a substantially quarter-circular cross-section extending in a manner curved radially outwardly from the rear end of the straight surface 25 to the front surface of the coupling 13. Fitting recesses 27 are provided on both vertical end parts of the straight surface 25 and define shallow grooves extending in the front-back direction. The rear ends of the fitting recesses 27 are connected to the slant 26 in a stepped manner.

As shown in FIG. 3, the slant portion 26 has a substantially rectangular shape long in the vertical direction in a front view. Both front and rear ends of the slant portion 26 are respectively continuous and flush with a central part of the straight surface portion 25 in the vertical direction and the front surface of the coupling portion 13 without any step (see FIG. 1). Further, both upper and lower ends of the slant portion 26 are connected to the front surface of the coupling portion 13 in a stepped manner.

Figure 4:
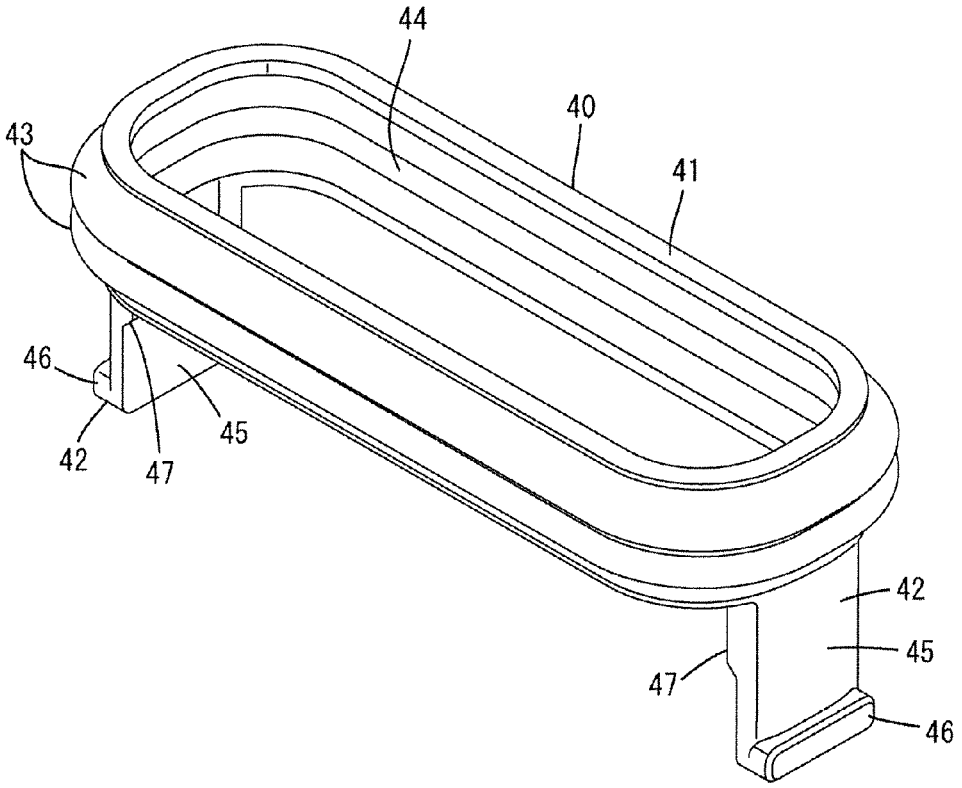
FIG. 4 is a perspective view of a seal prior to mounting.
Figure 6:
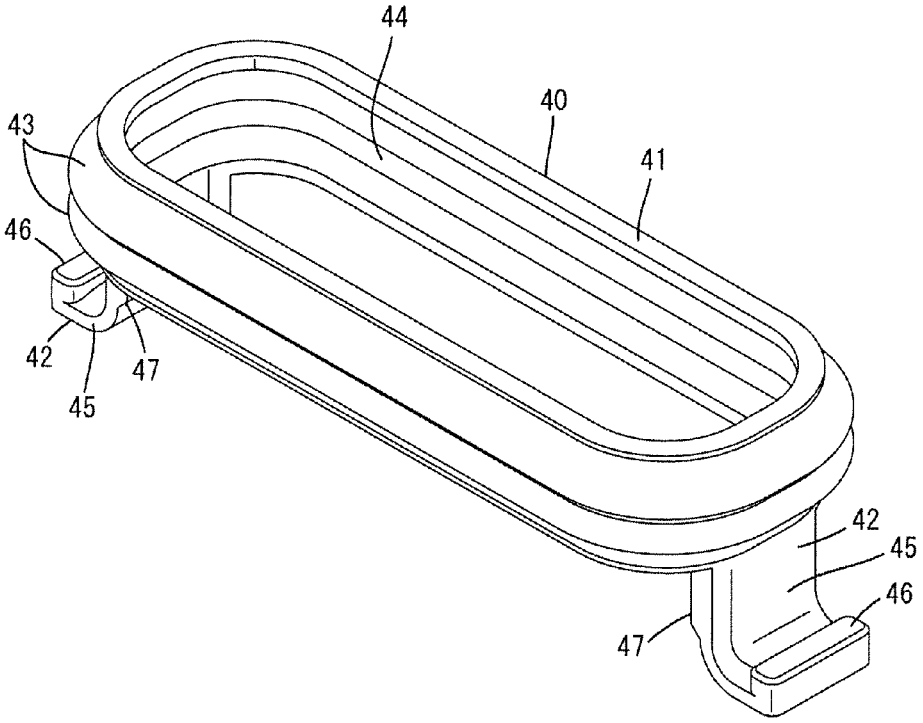
FIG. 6 is a perspective view of the seal in a mounted state.

The seal 40 is made of rubber, such as silicon rubber, and includes the annular portion 41 and two projections 42, as shown in FIGS. 4 and 6. The annular portion 41 is long in the lateral direction and the projections 42 project back from left and right ends of the annular portion 41. Outer peripheral lips 43 are provided over the entire outer peripheral surface of the annular portion 41. Two of the outer peripheral lips 43 are arranged symmetrically at opposite front and rear sides of a center of the annular portion 41 in the front-back direction. Further, inner peripheral lips 44 are provided over the entire circumference on the inner peripheral surface of the annular portion 41.

The annular portion 41 is fit externally on the mounting area 23 of the main body 11 when the seal 40 is mounted properly on the housing 10, as shown in FIG. 1. Further, the annular portion 41 is sandwiched resiliently in a radial direction between the receptacle 71 and the housing main body 11 when the two housings 10, 70 are connected. At this time, each outer peripheral lip 43 is squeezed and held in close contact with the inner peripheral surface of the receptacle 71 and each inner peripheral lip 44 is squeezed and held in close contact with the mounting area 23 of the main body 11, thereby sealing between the two housings 10, 70 in a liquid-tight manner.

As shown in FIGS. 4 to 7, the projection 42 is composed of a projecting main body 45 in the form of a deflectable strip projecting back from the rear end of the annular portion 41 and a backlash preventing portion 46 projecting out (forward in a mounted state to be described later) from the projecting end of the projecting main body 45. The projecting main body 45 has a constant vertical dimension over substantially the entire length in the front-back direction. Further, the backlash preventing portion 46 is in the form of a rib extending substantially over the entire length in the vertical direction on the rear end of the projecting main body 45. As shown in FIG. 1, the projecting end surface of the backlash preventing portion 46 is arranged along a radial direction in the mounted state. Two rib-like fittings 47 are provided on both vertical end parts of the inner surface of the projecting main body 45 and extend back from the rear end of the annular portion 41. The fittings 47 are arranged on a front part of the projecting main body 45. When the annular portion 41 is fit externally on the mounting area 23 of the housing main body 11, the fittings 47 are fit and inserted into the fitting recesses 27 (see FIG. 1).

Figure 5:
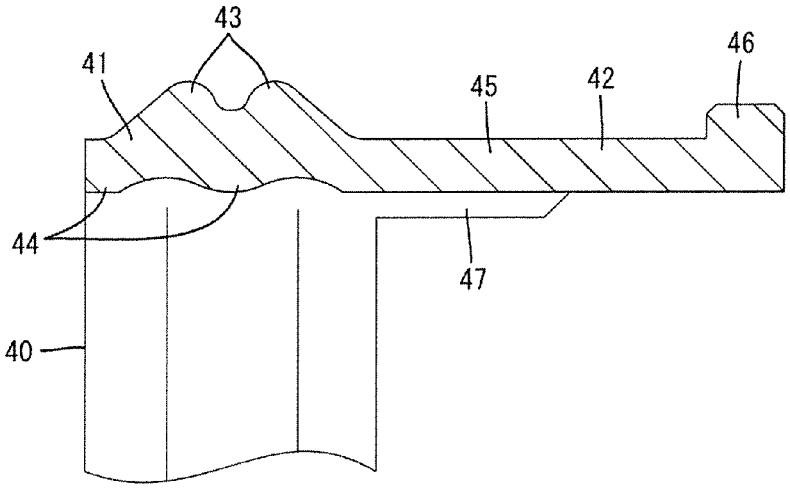
FIG. 5 is an enlarged section of an essential part of the seal.

The projection 42 takes different forms in an unmounted state (see FIGS. 4 and 5) and in the mounted state (see FIGS. 6 and 7) on the housing 10, and is deformed by the deformation guide 24 in the process of a transition from the unmounted state to the mounted state. Specifically, when the seal 40 is in the unmounted state, the projecting main body 45 projects substantially straight over the entire length in the front-back direction as shown in FIG. 5. Thus, in molding the seal 40, the projecting main bodies 45 can be molded easily by a mold from which the seal 40 is removed in the front-back direction.

Figure 7:
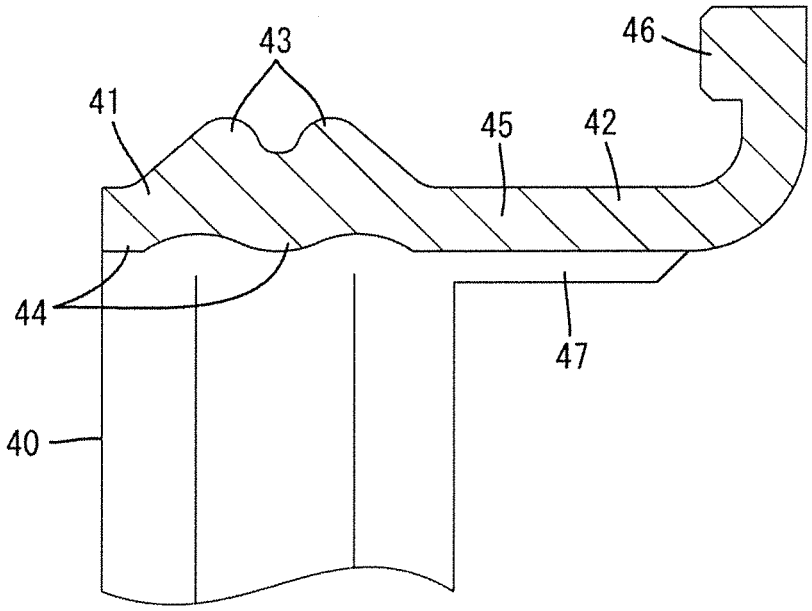
FIG. 7 is an enlarged section of an essential part of the seal in the mounted state.

A front end of the projecting main body 45 extends substantially straight in the front-back direction and a rear end protrudes radially out when the seal 40 is in the mounted state shown in FIG. 7, so that the projecting main body 45 extends in a curved manner from the front end to the rear end. The rear end of the projecting main body 45 protrudes radially out so that the backlash preventing portion 46 projects forward.

The seal 40 is mounted on the housing 10 by fitting the annular portion 41 externally on the main body 11 from the front. The projections 42 slide on the deformation guides 24 to gradually deform along the slants 26 before the annular portion 41 reaches a proper mounted position to be mounted on the mounting area 23 of the main body 11. Specifically, rear parts of the projections 42 gradually protrude radially out along the slants 26 in the process of mounting the seal 40. A radially outward bulging amount of the projections 42 gradually increases as the annular portion 41 approaches the proper mounted position.

The rear end parts of the projections 42 substantially stand radially out and the projections 42 are arranged in close contact with the substantially entire deformation guides 24 and also in close contact with the front surface of the coupling 13 when the annular portion 41 reaches the proper mounted position as shown in FIG. 1. Further, the fittings 47 are fit and inserted into the fitting recesses 27 and the rear ends thereof rest in contact with the rear ends of the fitting recesses 27 when the annular portion 41 reaches the proper mounted position. In this way, the annular portion 41 is hindered from being pushed to a back side beyond the proper mounted position.

Subsequently, the front member 20 is mounted on the housing main body 11 from the front. The front end of the annular portion 41 of the seal 40 is arranged to contact the rear end of the front member 20 when the front member 20 is mounted properly and the seal 40 is positioned in the front-back direction.

Subsequently, the main body 11 is fit into the receptacle 71 of the mating housing 70. When the two housings 10, 70 are connected properly and the receptacle 71 is inserted to a proper depth into the connection space 14 of the housing 10, each outer peripheral lip 43 of the annular portion 41 is squeezed and resiliently held in close contact with the inner peripheral surface of the receptacle 71 in the radial direction and the backlash preventing portions 46 are squeezed and resiliently held in close contact with the tip of the receptacle 71 in the front-back direction (see FIG. 1). The backlash preventing portion 46 resiliently contacts the tip of the receptacle 71 in this way, thereby ensuring a state where the lock receiving portion 19 of the lock arm 18 is in contact with the lock in the front-back direction and suppressing the backlash of the two housings 10, 70 in the front-back direction.

As described above, according to this embodiment, the radially outwardly protruding parts are formed on the rear parts of the projections 42 and the backlash of the two housings 10, 70 in the front-back direction is suppressed by the backlash preventing portions 46 projecting on the protruding parts when the seal 40 is in the mounted state. This can avoid a situation where the terminal fittings 60, 80 in a connected state are abraded due to sliding movements and can improve electrical reliability.

If the radially outwardly protruding parts are formed on the rear parts of the projections 42 in this way, it may be difficult to mold the front parts of the projections 42 extending along the front-back direction. However, in this embodiment, the radially outward protruding amount on the rear parts of the projecting portions 42 is suppressed and the rear parts of the projections 42 do not include the radially outwardly protruding parts except at the backlash preventing portions 46 when the seal 40 is unmounted. Thus, the front parts of the projections 42 can be molded easily. As a result, the mass productivity of the seal 40 can be improved.

Further, the projections 42 of the seal 40 are deformed smoothly by sliding on the slants 26 of the deformation guides 24 and the deformation guides 24 need not have a particularly complicated structure.

Other embodiments are briefly described below.

The seal may not include the backlash preventing portions projecting forward in the mounted state.

The rear end parts of the projecting main bodies may protrude radially outwardly a short distance when the seal is unmounted.

The projections may protrude at three or more circumferentially spaced-apart positions of the annular portion of the seal.

The projection may protrude over the entire circumference of the annular portion of the seal.

LIST OF REFERENCE SIGNS

10 . . . housing
11 . . . main body
24 . . . deformation guide
26 . . . slant
40 . . . seal
41 . . . annular portion
42 . . . projection
46 . . . backlash preventing portion
70 . . . mating housing

What is claimed is:

1. A waterproof connector, comprising:

a housing including a main body fittable into a receptacle of a mating housing; and a seal including an annular portion to be fit externally on the main body from a front of the main body and being resiliently sandwiched in a radial direction perpendicular to a front-back direction between the main body and the receptacle when the two housings are connected and two circumferentially spaced projections projecting back from opposite positions on the annular portion, a rear end of each of the projections remote from the annular portion defining a radially protruding part that protrudes radially out, the radially protruding parts having forwardly facing surfaces that resiliently contacts the tip of the receptacle in the front-back direction when the two housings are connected;

wherein the housing includes a deformation guide curved out and configured to deform the projections of the seal radially out such that a radially outward protruding amount of the projection gradually increases by sliding on the deformation guide while rearwardly moving the annular portion externally on the main body toward a proper mounted position.

2. The waterproof connector of claim 1, wherein the deformation guide includes a slant curved radially outwardly.

3. The waterproof connector of claim 2, wherein the radially protruding part of each of the projections includes a backlash preventing portion projecting forward and capable of contacting the tip of the receptacle in a state where the annular portion reaches a proper mounted position on the main body.

4. A waterproof connector, comprising:

a housing including a main body, a fitting tube spaced out from the main body, a coupling connecting a rear end of the fitting tube to the main body and a forwardly open connection space between the main body and the fitting tube for receiving a tubular receptacle of a mating housing, the coupling defining a closed rear end of the forwardly open connection space; and a seal including an annular portion fit in the forwardly open connection space and engaged sealingly around an outer surface of the main body so that the annular portion of the seal is sandwiched resiliently in a radial direction perpendicular to a front-back direction between the main body and the receptacle when the two housings are connected, two circumferentially spaced projections projecting back from opposite positions on the annular portion, a rear end of each of the projections remote from the annular portion defining a radially protruding part that protrudes radially out toward the fitting tube and engages against a forwardly facing surface of the coupling between the main body and the fitting tube, the radially protruding parts having forwardly facing surfaces, and the forwardly facing surface of each radially protruding part includes a backlash preventing portion projecting forward and capable of contacting a tip of the receptacle in a state where the annular portion reaches a proper mounted position on the main body.

5. The waterproof connector of claim 4, wherein the housing includes a deformation guide curved out and extending from the main body to the coupling and configured to deform the projections of the seal radially out such that a radially outward protruding amount of the projection gradually increases by sliding on the deformation guide while rearwardly moving the annular portion externally on the main body toward the proper mounted position.

6. The waterproof connector of claim 4, wherein inwardly facing surfaces of the projections are formed with rib-like fittings between the annular portion and the radially protruding parts and the main body of the housing has fitting recesses that engage the rib-like fittings when the annular portion of the seal is in the proper mount position.

* * * * *